United States Patent [19]

Bloemendaal

[11] Patent Number: 4,645,199

[45] Date of Patent: Feb. 24, 1987

[54] EXERCISE DEVICE

[75] Inventor: Brent J. Bloemendaal, Indianapolis, Ind.

[73] Assignee: Bio-Dynamic Innovations, Inc., Indianapolis, Ind.

[21] Appl. No.: 695,077

[22] Filed: Jan. 25, 1985

[51] Int. Cl.[4] ..... A63B 21/00

[52] U.S. Cl. ..... 272/73

[58] Field of Search ..... 272/73, 130, 72; 188/290; 192/58 B

[56] References Cited

U.S. PATENT DOCUMENTS

| | | | |
|---|---|---|---|
| 2,508,217 | 5/1950 | Brell | 188/290 |
| 2,725,231 | 11/1955 | Hoover . | |
| 3,211,396 | 10/1965 | McQuillen | 188/290 |
| 3,373,992 | 3/1968 | Ludeman . | |
| 3,494,616 | 2/1970 | Parsons | 272/73 |
| 3,529,474 | 9/1970 | Olson et al. . | |
| 3,531,112 | 9/1970 | Gibbs . | |
| 3,907,079 | 9/1975 | Chapman | 192/58.8 |
| 4,509,742 | 4/1985 | Cones | 272/73 |

OTHER PUBLICATIONS

Amerec Tunturi Cycle from "The Sharper Image Catalog", Jan., 1985, p. 5.

*Primary Examiner*—Richard J. Apley
*Assistant Examiner*—S. R. Crow
*Attorney, Agent, or Firm*—Litman, Day & McMahon

[57] ABSTRACT

An exercise device includes a rotor which rotates upon action of an operator. Resistance to rotation of the rotor is provided by fluid trapped between the rotor and a non-rotating portion of the device. A friction relief mechanism provides periodic variation in the amount of resistance to rotation as the rotor is rotated. A fluid level adjustment mechanism permits control of the amount of fluid positioned between the rotor and the non-rotating portion of the device. As the amount of fluid between the rotor and the non-rotating portions of the assembly is increased, the total amount of energy required to complete a single revolution of the rotor is generally increased. In a preferred embodiment, the device is an exercise cycle operated by pedaling. The friction relief mechanism operates so that when the pedaler has pedals positioned at vertical extremes, resistance to pedaling is least; and when the pedals are positioned substantially halfway between the vertical extremes, resistance to pedaling is at a maximum. This periodic variation in the amount of energy required for rotation, caused by the friction relief mechanism, generally matches a profile of a normal bicycle pedaler's muscle capabilities and output.

25 Claims, 8 Drawing Figures

EXERCISE DEVICE

BACKGROUND OF THE INVENTION

The present invention relates to exercise devices and in particular to exercise cycles generally utilized for aerobic exercise and cardiovascular stimulation wherein for operation an exerciser pedals the device in a manner similar to a bicycle.

Conventional exercise cycles are generally intended to simulate bicycle riding. For operation of the devices, an exerciser generally sits astride the device and rotates a pedal axle by means of pedals such as bicycle pedals. Exercise is received by the operator, since energy is required for the pedaling action.

Conventional exercise cycles are generally of two basic types: in the first, the pedal action communicates with a wheel by mechanical means such as a chain. As the pedal axle is rotated by pedaling action of the exerciser, the wheel is rotated. Resistance to rotation of the wheel is generally provided by an adjustable mechanical device causing a friction brake to engage a surface of the wheel. As resistance to rotation of the wheel is increased, more energy is required to pedal the axle and the exerciser receives a greater workout. Unlike a bicycle, the rotating wheel is generally suspended out of ground contact, so that the device remains stationary while being used.

Such conventional devices generally suffer from two interrelated problems. First, they do not simulate bicycle riding well and secondly, they are often uncomfortable for the user. The reasons for these problems are understandable by reference to conventional bicycle riding.

In a conventional bicycle, as with conventional exercise cycles, the pedals are mounted upon pedal arms which are oriented 180° out-of-phase with one another. Thus, whenever the right pedal arm is at its maximum upward extension, the left pedal arm is at its maximum downward extension. In a typical pedaling cycle, a pedal arm begins at 0°, that is extending straight upward, rotates to 90°, that is extending toward the front part of the bicycle, continues to rotate through 180°, that is bottom dead center, through 270° and back to 0°; or through a 360° arc. The opposite pedal being 180° out-of-phase, begins at 180° rotates through 270°, 0°, 90° and back to 270°.

It is readily seen that for the conventional bicycle, maximum rotative force can be more readily applied to a pedal, mounted on a pedal arm, when the pedal arm is located at the 90° position, that is extending forwardly. If the sum of the two pedal arms is considered, the amount of torque which may be easily applied by a rider is at a maximum when the pedal arms are horizontal and at a minimum when the pedal arms are vertical. This results from a general location of the bicycle seat vertically above the pedal axle.

One of the reasons bicycle riding is relatively comfortable is because the shape of the human body and the capabilities of human leg muscles generally correspond to the same pattern as the above torque pattern for pedaling. That is, the human bicycle rider generally finds that his or her legs are more capable of providing torque, or imparting power to the pedals, when the pedal arms are substantially horizontal.

As a human rides a bicycle, the amount of power transmitted to the wheel, through the pedaling action, increases and decreases on a periodic cycle. Generally, the amount of power is at a maximum when the pedal arms are in a horizontal position and at a minimum when the pedal arms are generally vertical. The rider feels a smooth pedaling action for the reason that this generally sinusoidal periodicity somewhat matches muscle capability, and also because the forward momentum of the bicycle generally carries the pedaler through top and bottom dead center without the need for much work.

In conventional exercise cycles of the first described type, since the cycle is stationary, there is no forward momentum to help carry the pedaler through top and bottom dead center. Since the amount of friction provided by the brake is constant, at any given point in the pedaling cycle the same amount of energy is required to rotate the wheel at a constant speed. Since it is easier to impart power to the pedals when the pedal arms are horizontal, the exerciser generally finds it easier to pedal when the pedals are horizontal and harder to pedal when the pedal arms are vertical. Thus, a smooth, comfortable pedaling action is not obtained, and it is hard to maintain a constant pedaling speed.

A second type of conventional exercise cycle has been developed to overcome some of these problems. In these cycles, the wheel which is rotated by action of the pedal axle is very heavy and acts as a fly wheel to carry the pedals through top and bottom dead center. Thus, if the pedaler relaxes somewhat at top and bottom dead center, that is when the pedal arms extend vertically, the momentum of the wheel will carry the pedal arms through the vertical position toward the horizontal, where pedaling is easier. A problem with the second type of conventional exercise cycle is that the fly wheels can take up considerable space, may be relatively heavy, and may be relatively expensive to manufacture. Further, the exerciser may encounter pedaling discomfort when the rotational speed of the heavy fly wheel is being increased or decreased.

SUMMARY OF THE INVENTION

An exercise device is provided for use by an operator in receiving physical exercise or a workout. In the preferred embodiment, operation of the device is by pedaling action of the legs of the user, however, the principles of the invention may be applied to a device operated by arm movement of the user.

The exercise device generally comprises an exercise cycle including a frame, seat, handle bars and pedal mechanism. The frame includes a front upright support and a rear upright support, with the pedal mechanism suspended therebetween. The seat and handle bars are positioned with respect to the pedal mechanism in a manner similar to a bicycle.

The pedal mechanism includes a pair of pedal arms mounted upon a rotatable axle and extending generally outwardly therefrom. The pedal arms are oriented generally 180° out-of-phase with one another and pedals mounted thereon permit leg operated pedaling of the device to generate rotation of the pedal axle.

A rotor is securely mounted on the rotating axle. The rotor is a generally flat plate having first and second surfaces. The rotor is oriented in a generally vertical plane and rotates as the pedal axle is rotated by the operator.

The rotor is oriented within a chamber between a housing and a cover. Fluid receiving spaces are positioned between the rotor and the housing and also between the rotor and the cover. When fluid is conveyed into the fluid receiving spaces, frictional drag on rotation of the rotor is generated. This drag, or resistance, may be increased or decreased by varying the amount of fluid in the fluid receiving spaces, with the general condition that the greater the amount of fluid, the greater the amount of frictional drag. The method of transmitting fluid into the fluid receiving spaces generally places the fluid along a circumferential perimeter of each of the faces of the rotor.

For a fixed volume of fluid located between the rotor and the housing, the distance between the rotor and the housing is related to the amount of frictional drag generated. Generally, for a fixed volume of fluid, the greater the distance between the rotor and the housing, the less will be the frictional drag, since less surface area of the rotor and the housing will be covered by the fluid. Alternatively stated, as the distance between the rotor and housing increases, the shearing action of the fluid decreases, and rotation becomes easier. Similarly, the distance between the rotor and the cover will be important.

The device includes a fluid level adjustment means by which an amount of fluid located in the spaces between the rotor, housing and cover can be varied and controlled. When the amount of fluid is increased, as indicated above, the amount of resistance to pedaling action is generally increased.

If the rotor is substantially circular and the cover and housing, where they overlap the rotor, are substantially flat and parallel to the rotor, then generally constant frictional drag, at a fixed fluid level, is experienced throughout single rotation of the rotor, at a constant speed. This latter observation assumes that the temperature and viscosity of the fluid remain relatively constant. A modification in the structure thusfar described, is desirable, or the operator will feel similar increases and decreases in ease of pedaling, as the pedal arms are rotated, as would be felt for a conventional exercise cycle without a fly wheel.

A friction relief mechanism is provided so that the amount of energy required, to cause rotation of the rotor, varies with periodicity during rotation of the rotor. The friction relief mechanism comprises changes made, from a circular configuration, in the rotor, the housing surface which overlaps the rotor, and the cover surface which overlaps the rotor.

The rotor has a configuration which would be circular except that two equal and opposite 80° chordal segments have been removed therefrom. As a result, the rotor has two opposite, equal, and parallel straight edges, and two opposite and equal curved edges.

The housing surface which faces the rotor generally has a circular track thereon, with two equal and opposite 80° chordal frictional relief portions. The housing circular track is substantially flat and positioned in a vertical plane. The frictional relief portions are generally symmetrically positioned at positions of general vertical maxima and minima in the housing.

As the rotor is rotated upon the pedal axle, the amount of overlap between the rotor and the housing frictional track will vary. Part of the time, the curved edges of the rotor will completely overlap the circular friction track, potentially trapping fluid therebetween. In this orientation, there is maximal overlap between the rotor and the housing frictional track, so greater surface is available for the fluid to act upon and maximum frictional drag or resistance to rotation of the rotor is felt.

If the rotor is rotated 90° from a position of maximum overlap, a position of minimal overlap is achieved. In the position of minimal overlap, the curved portions of the rotor overlap the relief portions in the circular friction track. A greater distance between the rotor and the housing, at the relief portion, will cause less resistance to rotation for a given volume of fluid. This orientation of minimal friction occurs generally whenever the rotor is positioned so that the opposite and parallel straight edges extend generally vertically. The position of maximum resistance generally occurs whenever the opposite and parallel side edges of the rotor are positioned substantially horizontally.

As the rotor is rotated through a single revolution, two friction maxima and two friction minima are encountered, at a fixed fluid level. Also, the amount of frictional drag generally gradually changes between the maxima and minima, causing a generally sinusoidal shaped curve representing the amount of energy needed to rotate the rotor, at a constant speed and fixed fluid level, as a function of a degree of rotation.

Ideally, the frictional drag, per revolution of the rotor, changes in the same manner as the exerciser's capabilities of imparting torque to the pedals. That is, when the pedals are at top dead center and bottom dead center the frictional drag is least; and, when the pedals are oriented generally with the pedals arms horizontal, the frictional drag is near its greatest. In this arrangment, the exerciser or operator feels a smooth resistance to pedaling during a complete revolution of the pedals and rotor. Again, this latter is due to the general condition that as the frictional drag increases, the ability of the exerciser to impart energy to the pedal also increases; and, as the frictional drag decreases, the ability of the operator to impart energy through the pedals also decreases. A method of accomplishing this is to have the rotor mounted on the pedal axle in an orientation of particular relationship with respect to the pedal arms. Specifically, the pedal arms are aligned generally parallel to the straight side edges of the rotor, or bisecting the curved edges. Thus, when the curved edges of the rotor generally overlap the relief portions of the housing, the pedal arms are oriented vertically.

As mentioned above, a second fluid receiving space is positioned between the rotor and the cover. Generally, the cover will be understood to have a friction track similar to that for the housing. Cover friction relief portions are located generally analagously to those for the housing.

It will be understood that a variety of designs of rotors and housings may be utilized according to the present invention. Generally, it is the amount of surface area between which the fluid is trapped that is most critical to the amount of frictional drag created. For a given volume of fluid, as indicated above, the distance between the rotor and the housing will be important, since the greater the distance, the less will be the amount of surface area covered by the fluid. Also, as the distance is increased, the shearing action of the fluid decreases.

For the preferred embodiment, a fluid having a viscosity of approximately 9,000 centistokes is used. However, a range of about 3,000 centistokes to about 22,000 centistokes is operable. A stoke is a conventional unit of viscosity related to the length of time it takes a certain volume of material to flow a certain distance. In the preferred embodiments, silicon fluids are utilized and their consistency is observed to be generally similar to that of a cross between honey and molasses. Two such silicon fluids are believed to be marketed under the trade name Dow Corning 211 and Union Carbide 404.

While the fluid possesses significant viscosity, it is still sufficiently free flowing that it will tend to smear itself over much of the internal portions of the pedal mechanism, if it is allowed to do so. In the preferred embodiment, a wiper mechanism is provided in association with the rotor. The wiper mechanism continuously redirects the fluid to that portion of the rotor which is to be covered thereby. Generally, the wiper mechanism operates by directing the fluid toward an outer periphery of the rotor. The wiper mechanism comprises a flexible blade which is pressed against the rotor surface. As the rotor rotates, the fluid is pushed up against the wiper blade and is directed by wiper fingers toward the outer periphery of the rotor.

A fluid reservoir is provided so that the total amount of fluid between the rotor and housing may be varied. When the amount of fluid between the rotor and housing is increased, pedaling becomes harder, although ease of pedaling still varies according to a sinusoidal curve as described above. This is similar to the shifting of gears on a bicycle. Overall pedaling may be more difficult; however, smoothness to the operator, during a single pedaling cycle, is maintained. The fluid reservoir includes a plunger which is actuated to force fluid into, or allow fluid to escape from, a chamber in which the rotor rotates.

A potential problem with such fluid systems is that air bubbles may form within the viscous fluid. Generally, if the fluid is continuously stirred or agitated such bubbles can escape. In the preferred embodiment, a scraper mechanism is provided to help remove bubbles from the viscous fluid. As the rotor rotates, it forces the fluid past the scraper. The scraper causes some agitation in the fluid, helping air bubbles to escape.

It is foreseen that the fluid adjustment mechanism, which comprises the plunger and fluid reservoir, may be controlled either manually by the operator, or by a computer. With computer control, programming to simulate a variety of bicycle trips may be possible. For example, inclines, declines and flat pavement may be simulated.

It is also foreseen that exercise devices encompassing the present invention may be utilized as diagnostic tools. For the exercise cycle described in the preferred embodiment, at a fixed fluid level, the operator should have no trouble rotating the pedals at a constant speed. Again, this is accommodated by the feature which allows for less frictional drag at the same point in the pedal stroke where the operator is less able to impart rotational energy to the rotor. So again, for this device, the operator should be able to pedal at a steady rate of speed with little difficulty. If, upon evaluation, it is observed that the operator has trouble during a particular arc of rotation of the rotor, this might be indicative of a particular muscular problem in the legs of the operator. Therefore, the device would have potential use as a diagnostic tool for evaluating the legs and leg muscles of the pedaler.

OBJECTS OF THE INVENTION

Therefore, the objects of the present invention are: to provide an exercise device which requires an operator to expend energy in rotating a rotor; to provide such a device in which the rotor is rotated by pedaling action generated by the legs of the operator; to provide such a device in which the rotor has friction surfaces which rotate with respect to stationary surfaces in the device; to provide such a device in which fluid positioned between a rotor friction surface and a stationary surface transmits friction or causes drag to rotation of the rotor; to provide such a device in which an amount of fluid positioned between a rotor friction surface and a stationary surface can be adjusted to increase or decrease the amount of power needed for the pedaling action; to provide such a device in which an amount of energy required for pedaling varies during a pedaling cycle and periodically repeats in successive cycles; to provide such a device in which the amount of energy required for rotation, at a constant speed of rotation and fixed fluid volume, is at a maximum when pedal arms are located generally horizontally and at a minimum when the pedal arms are located generally vertically, in order to substantially match the capabilities of a pedaler to apply torque to the pedals; to provide such a device in which the rotor rotates between a housing and a cover; to provide such a device in which fluid may be positioned between the rotor and the housing and also between the rotor and the cover to cause frictional drag to rotation of the rotor; to provide such a device in which heat transferred to the fluid is relatively rapidly dissipated, so that the viscosity of the fluid is not substantially changed during rotation of the rotor; to provide such a device which includes a wiper for controlling positioning of the fluid on the rotating rotor; to provide such a device which includes a scraper mechanism for generally separating fluid from the rotor; to provide such a device which is relatively compact in construction; to provide such a device which is relatively inexpensive to produce; and to provide such a device which is relatively easy to manufacture, relatively simple to use and which is particularly well adapted for the proposed usages thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof. In some instances material thickness and distances between portions of the device have been exaggerated, or reduced, for clarity and simplification.

DETAILED DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
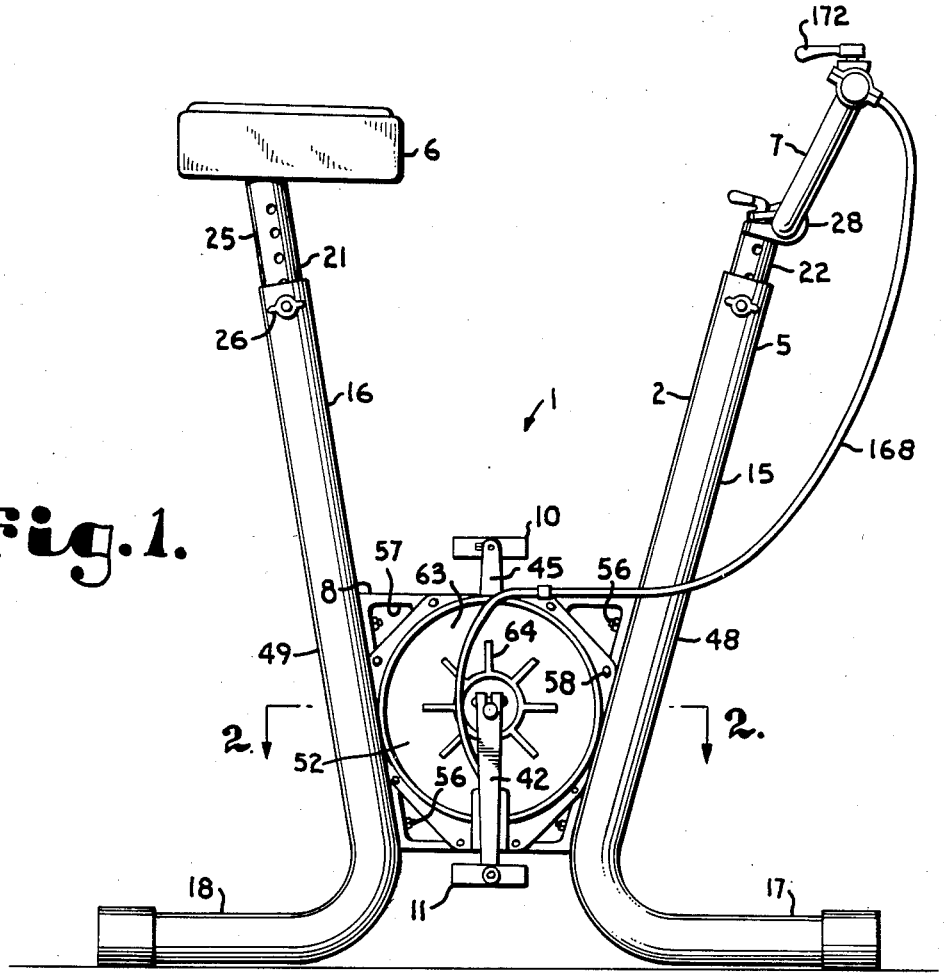
FIG. 1 is a side elevational view of an exercise device according to the present invention.

The reference numeral 1, FIG. 1, generally designates an exercise device according to the present invention. For the preferred embodiment described, the exercise device 1 comprises an exercise cycle 2 which includes a frame 5, a seat 6, handle bars 7 and an actuator means or pedal mechanism 8. Generally, the exercise device 1 is operated in an analagous manner to any conventional exercycle or exercise bicycle. That is, an operator sits astride the seat 6 with his feet placed upon left and right pedals 10 and 11 respectively, and with his hands resting upon the handle bars 7. Exercise is derived by pedaling the pedals 10 and 11. Generally, such exercise devices are used to cause an increase in heart rate and thus exercise to the cardiovascular system, however, certain muscular exercise may also be achieved.

The frame 5 includes front and rear upright members, 15 and 16 respectively, and front and rear floor engaging members, 17 and 18 respectively. The pedal mechanism 8 is suspended between the front frame member 15 and the rear frame member 16, in position for pedal engagement by an operator. Generally, a variety of frames 5 may be utilized; however, usually the seat 6 and pedal mechanism 8 must be appropriately positioned with respect to one another and, the frame 5 should be fairly securely supported in an upright position.

A conventional seat height adjustment mechanism 21 and handle bar height adjustment mechanism 22 are provided so that different operators will feel comfortable sitting astride the device 1. The seat height adjustment mechanism 21 comprises a post 25 and key 26. The seat 6 is mounted upon the vertically adjustable post 25. As the key 26 is adjusted, the post 25 may be raised and lowered. The handle bar height adjustment mechanism 22 operates in a similar manner. Both adjustment mechanisms 21 and 22 are of conventional design and a variety of arrangements may be utilized in connection with the present invention. Also, the handle bar 7 is mounted upon a bracket 28 which may be loosened to allow rotational orientation of the handle bar 7, with respect to the bracket 28, to be varied. Again, a variety of brackets 28, of conventional design, may be utilized in cooperation with the present invention.

Figure 2:
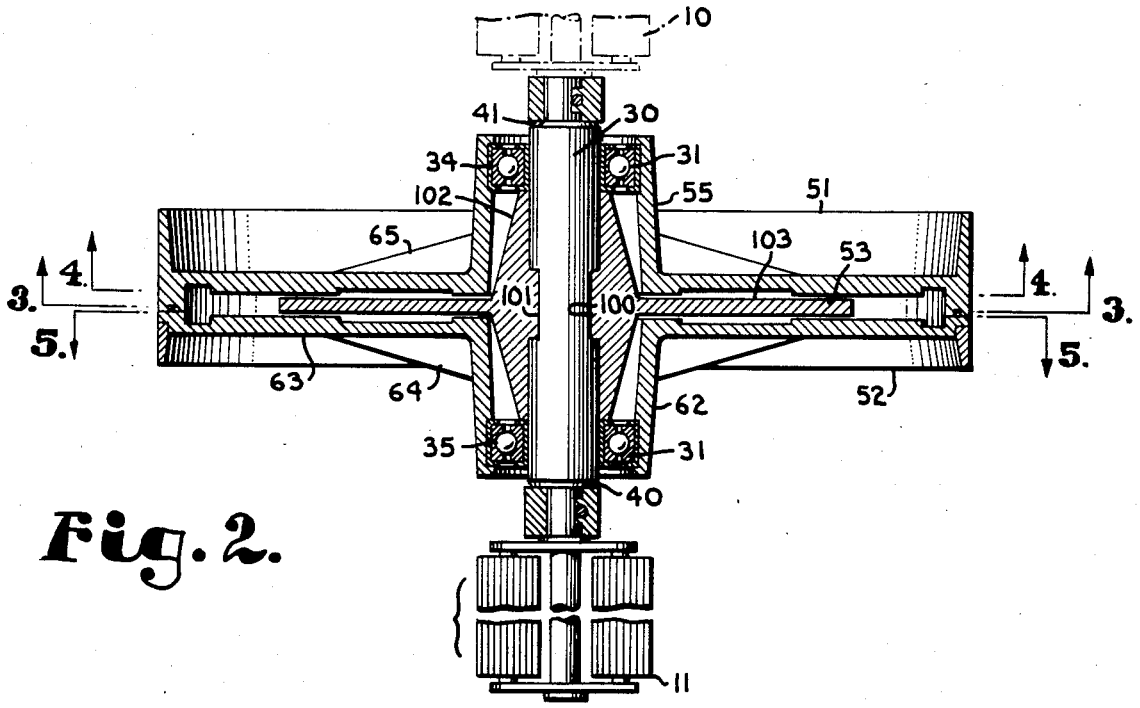
FIG. 2 is an enlarged, fragmentary top cross-sectional view of the exercise device taken generally along line 2—2 of FIG. 1.

Referring to FIG. 2, similarly to a conventional bicycle or cycle exercise device, the pedal mechanism 8 includes a pedal axle 30 rotatably mounted and horizontally supported within the pedal mechanism 8 by bearings 31. For the preferred embodiment, FIG. 2, the bearings 31 comprise first and second rings of bearings 34 and 35 mounted within the pedal mechanism 8 to rotatably support pedal axle 30 in a horizontal position.

Referring again to FIG. 2, the pedal axle 30 includes a first end 40 and a second end 41. Referring to FIG. 1, a first pedal arm 42 is securely mounted upon the pedal axle first end 40. The method of mounting may be as is conventional for pedal arms, that is with an end of the pedal arm comprising a clamp which is securely mounted upon the axle 30. Analagously, the second end 41 of the pedal axle 30 includes a second pedal arm 45, FIG. 1, mounted thereon. The pedal arms 42 and 45 are generally mounted to extend oppositely one another, FIG. 1. That is, when the pedal axle 30 is oriented so that the first pedal arm 42 extends downwardly, the second pedal arm 45 extends upwardly. As the pedals 10 and 11, mounted upon the pedal arms 42 and 45, are engaged by an operator, not shown, to rotate the pedal axle 30, the pedal arms 42 and 45 rotate 180° out-of-phase with one another. In FIG. 1, pedal arm 45 is shown at the 0° position or oriented generally extending straight up; and, pedal arm 42 is shown at the 180° position, or oriented to extend generally straight down. For reference herein, pedal 10, FIG. 1, will be referred to as being at the top dead center position, and the second pedal 11 will be referred to as being at the bottom dead center position. When a pedal is in a top dead center position, force must be applied in the direction of a front 48 of the exercise cycle 2 for rotation of the pedal axle 30 to be achieved. When a pedal is in a bottom dead center position force, in order to cause rotation of the pedal axle 30, must be generally oriented in a direction toward the rear 49 of the exercise cycle 2. Since both pedals 10 and 11 are simultaneously engaged, it is the sum of the forces which is most important.

With respect to imparting energy, through torque, to rotation of the pedal axle 30, an operator of the exercise cycle 2 will generally be able to take advantage of the greatest torque when the pedal arms 42 and 45 are oriented to extend generally horizontally, and frontwardly, as, for example, would be the case for pedal arm 45, FIG. 1, when the axle 30 is rotated clockwise 90°, when viewed as shown in FIG. 1, from its position. At that point, downward pressure on pedal 10 is efficiently transmitted to rotative force applied to the axle 30. When the pedals 10 and 11 are oriented in either top dead center or bottom dead center, FIG. 1, however, downward force does not result in any rotative force applied to the axle. This is generally true of any conventional cycle system which is operated by leg operated pedals.

Generally, human muscles are developed so that greater force in a direction generating rotation of the pedal axle 30, can be applied by an operator to the pedals 10 and 11 whenever the pedal arms 42 and 45 are oriented to extend generally horizontally and frontwardly. Thus, the leg muscles of a human, and generally the structure of the human body, coordinate well with the pedal mechanism. That is, greater downward force can be applied by a human operator at a point where greater downward force will do the most good, in terms of transmitting energy toward rotation of the pedal axle 30.

Resistance to pedaling action by an operator causes an operator to expend more energy in pedaling and thus to receive more exercise. The following description details the manner in which resistance to rotation of the pedal axle 30 is generated.

The pedal mechanism 8 includes a housing 51, a cover 52 and a rotor 53, FIG. 2. The rotor 53 is mounted upon the pedal axle 30 and rotates whenever the pedal axle 30 is rotated.

Figure 3:
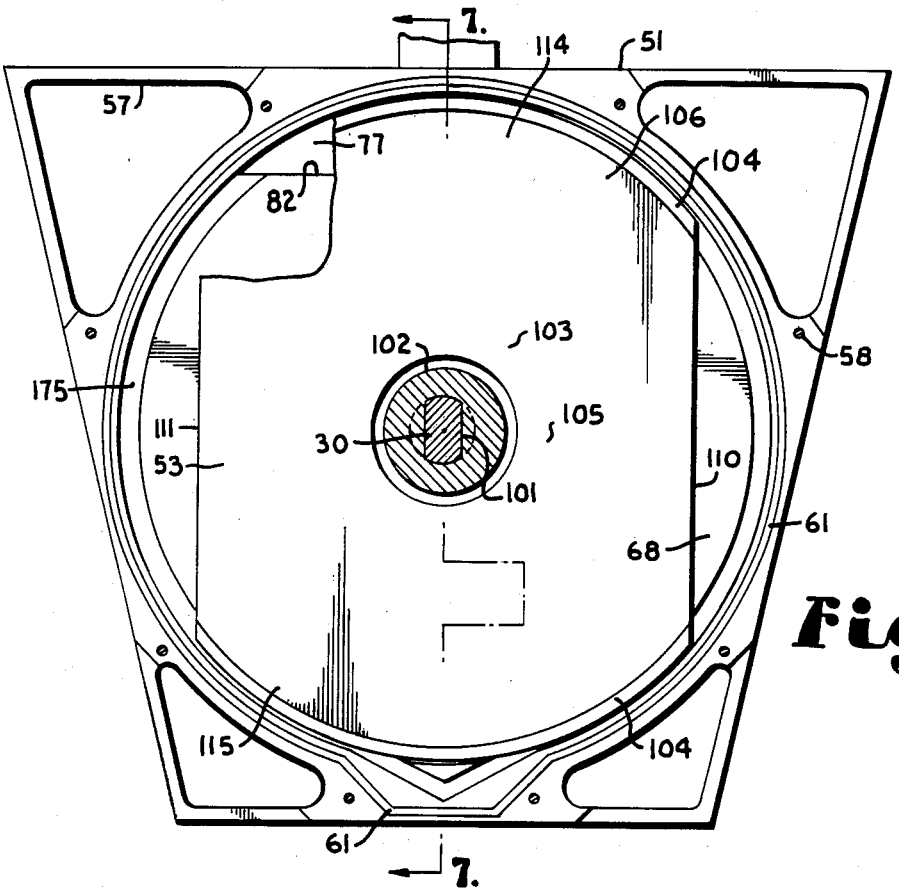
FIG. 3 is an enlarged, fragmentary side cross-sectional view of the exercise device taken generally alone line 3—3 of FIG. 2; certain portions have been broken away to show detail.
Figure 7:
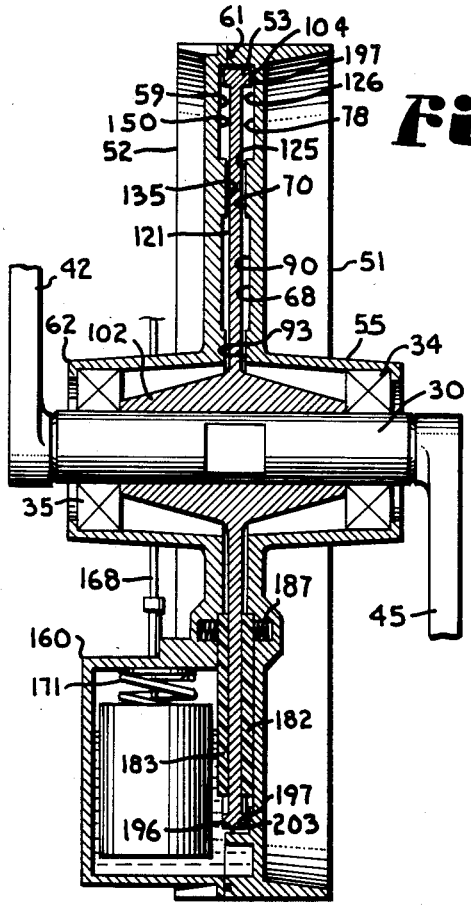
FIG. 7 is an enlarged, fragmentary, cross-sectional view of the exercise device taken generally along line 7—7 of FIG. 3.

Referring to FIGS. 3 and 7, the housing 51 includes a central hub 55 extending outwardly therefrom. The circular bearing 34 is mounted within the hub 55 to support the pedal axle 30. Referring to FIG. 1, the housing 51 is mounted upon the frame 5 as by bolts 56. Spaces 57 in the housing 51 permit a lighter structure.

Referring again to FIG. 7, the cover 52 is mounted adjacent the housing 51. In FIG. 1, the cover 52 is shown mounted upon the housing 51 by bolts 58 positioned around an outer periphery of the cover 52. Referring to FIG. 7, fluid receiving spaces 59 are left between the cover 52 and the housing 51. The rotor 53 is mounted upon the pedal axle 30 to rotate within the fluid receiving spaces 59. Generally fluid will partially occupy the fluid receiving spaces 59 and a seal such as an O-ring type seal 61, FIG. 7, prevents leakage of fluid out from between the cover 52 and the housing 51.

The cover 52 includes an outwardly extending hub 62 having the circular bearing 35 mounted therein to support the pedal axle 30.

From the above description, it will be understood that the pedal axle 30 is securely held in position by the housing 51 and the cover 52. Referring to FIG. 1, an outer surface 63 of the cover 52 includes gussets 64 thereon for strength. Similar gussets 65, FIG. 2, in the housing 51 strengthen the housing 51 and ensure secure support of the axle 30.

The designs of the housing 51, cover 52 and rotor 53 cooperate to form an adjustable, periodically cycling, friction relief mechanism which generates many of the advantages of the present invention. Each of the housing 51, cover 52 and rotor 53 are described in detail below. Following their description, a description of their cooperation to form a friction relief or resistance system to pedaling action is described.

Figure 4:
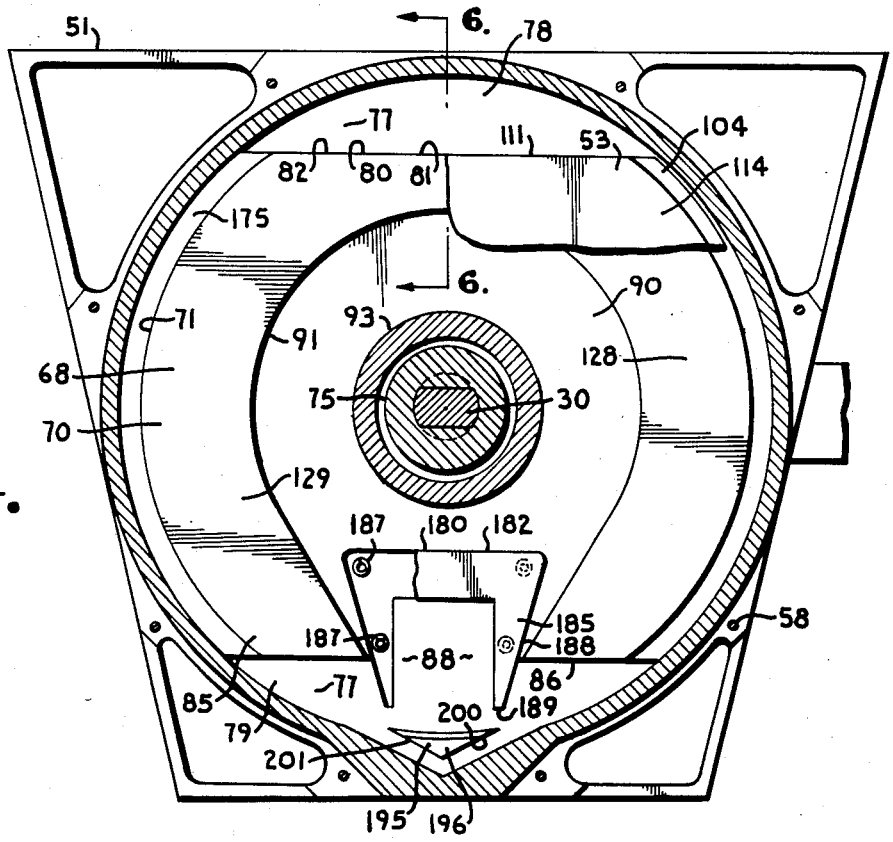
FIG. 4 is an enlarged, fragmentary, side cross-sectional view of the exercise device taken generally along line 4—4, FIG. 2 and having portions broken away to show detail.

Referring to FIGS. 3, 4 and 7, the housing 51 has an inner surface 68 which faces the cover 52 and rotor 53. By reference to FIG. 7, a cross-section showing the housing 51, it will be understood that the housing inner surface 68 is irregular. That is, the housing inner surface 68 includes portions which, in relief, are raised or lowered with respect to one another. Referring to FIG. 4, the housing inner surface includes a circular friction track 70, corresponding to a portion of the housing inner surface 68 which, in relief, is substantially raised and extends somewhat toward the cover 52, FIG. 7. The housing circular friction track 70 has a substantially circular outer periphery 71 which, except as described below, extends around a central portion 75 of the housing 51 through which the pedal axle 30 extends.

Figure 6:
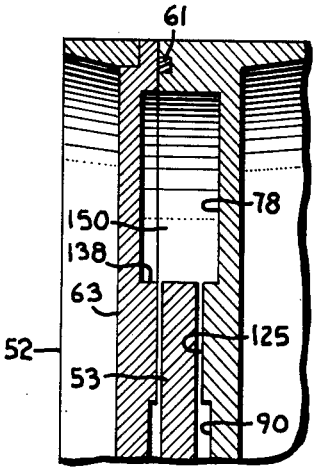
FIG. 6 is an enlarged, fragmentary cross-sectional view taken generally along line 6—6 of FIG. 4.

Referring to FIG. 4, the housing circular track is interrupted by a housing friction relief portion 77. In the preferred embodiment, the housing friction relief portion 77 includes a first chordal relief segment 78 and a second chordal relief segment 79. The first chordal relief segment 78 comprises a portion of the housing inner surface 68 of greater relief than the circular friction track 70. By "greater relief" it is meant that the portion of the housing inner surface 68 which comprises the chordal relief segment 78 is spaced further from the rotor 53 than is the circular friction track 70. This is seen by reference to FIGS. 6 and 7. The designation "chordal relief segment" refers to the feature that relief segment 78 substantially represents a portion of the circular friction track 70 which has been relieved along a chordal segment 80. Referring to FIG. 4, the first chordal relief segment 78 is positioned near an upper portion 81 of the circular friction track 70. The first chordal relief segment 78 leaves the circular friction track 70 with an upper horizontal edge 82.

The second chordal segment 79 comprises an similarly relieved portion of the circular friction track 70, near the lower part 85 of the circular friction track 70. Therefore, the circular friction track 70 includes a lower horizontal edge 86. A gap 88 in the lower horizontal edge 86 is to accommodate portions of the exercise cycle 2 described below.

The housing inner surface 68 also includes a fluid relief drain 90, FIGS. 4 and 7. The relief drain 90 comprises a recessed portion of the housing inner surface 68 which defines an inner edge 91 of the circular friction track 70. A central circular raised portion 93 of the housing inner surface 68 protects the pedal axle 30 from fluid received within the receiving spaces 59. Referring to FIG. 4, any fluid which flows inwardly from the inner edge 91 of the circular friction track 70 will generally flow into the relief drain 90 and will eventually run downwardly along the housing inner surface 68 until it reaches gap 88 and seaps into the second chordal segment 79. Central raised portion 93 protects the axle 30 from fluid flow thereto.

As indicated above, the rotor 53 is mounted upon the pedal axle 30 and rotates therewith. Generally, the rotor 53 is molded plastic or metal, cast directly upon the axle 30. Referring to FIG. 2, extensions 100 on the rotor 53 engage indentations 101 in the axle 30 to prevent any slippage in the connection between the rotor 53 and the axle 30.

The rotor 53 includes a central circular hub 102, a central flat portion 103, FIG. 2, and an outer rim 104, FIG. 7. Referring to FIG. 3, the rotor 53, of the preferred embodiment, has a substantially circular configuration with two chordal segments relieved. Thus, the central flat portion 103 has a central uninterrupted part 105 and an outer periphery 106. In FIG. 3, a first chordal segment has been removed, generating straight edge 110 on the rotor 53. A second chordal segment has been removed generating opposite and parallel straight edge 111. The rotor 53, as a result, has two opposite and equal curved extensions or edge portions 114 and 115, and two opposite and equal parallel side edges 110 and 111. The rim 104 comprises a raised extension along each of the curved edges 114 and 115, FIG. 3 and FIG. 7.

Figure 8:
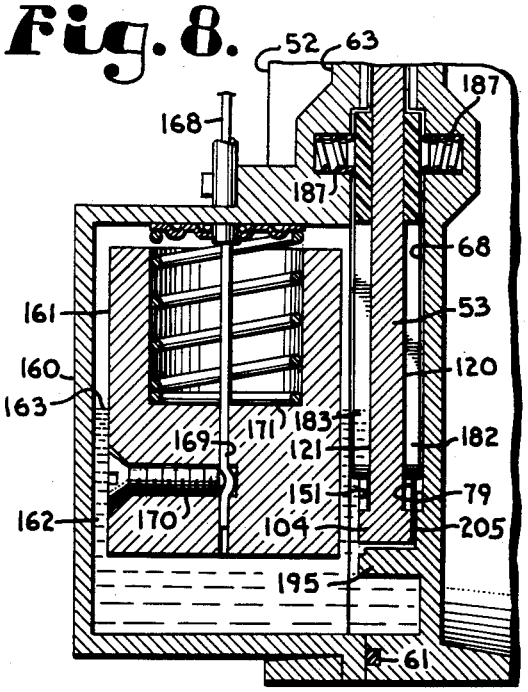
FIG. 8 is an enlarged, fragmentary, side cross-sectional view of a portion of the apparatus shown in FIG. 7.

The central portion 103 of the rotor 53 is generally flat and has a first side 120 and a second side 121, FIG. 8. In the preferred embodiment, the rotor 53 is mounted upon axle 30 with the first side 120 generally facing the housing inner surface 68, and spaced somewhat apart therefrom. The rotor 53 generally rotates within a vertical plane and preferably does not substantially wobble with respect to the housing inner surface 68.

Referring to FIG. 7, if air occupies space 125 between the rotor 53 and the housing inner surface 68, then the housing inner surface 68 will offer very little resistance to the rotation of the rotor 53 upon pedaling the exercise cycle. On the other hand, if a viscous fluid is placed within space 125, it will tend to cause frictional drag to rotation of the rotor 53. It is readily seen that as the amount of fluid between the circular friction track 70 and the rotor 53 is increased, greater surface area of the rotor 53 engages the fluid and frictional drag is generally increased.

Referring to FIG. 3, when the rotor 53 is oriented with respect to the housing 51 in a manner shown in FIG. 3, a substantial portion of the first side 120 of the rotor 53 overlaps the first chordal relief segment 78 and second chordal relief segment 79 of the housing 51. Referring to FIG. 7, when fluid on the rotor 53 is trapped within space 126, that is adjacent the first chordal segment 78, it will offer less resistance to rotation of the rotor 53, since the distance between the rotor first side 120 and the housing inner surface 68 is relatively great at space 126. It will be generally understood that resistance to rotation will only be significant when the rotor first side 120 is substantially adjacent the housing inner surface 68 as it is when it is adjacent the circular friction track 70 at gap 125.

In FIG. 4, a fragmentary portion of the rotor 53 is shown oriented rotated 90° with respect to FIG. 3. In this orientation, the side edges 110 and 111 of the rotor 53 are understood to be substantially parallel to, and adjacent, horizontal edges 82 and 86 of the housing circular friction track 70. In this orientation the curved extensions 114 and 115 are aligned with, and generally overlap, side curved portions 128 and 129 of the circular friction track 70. It is readily seen that a greater surface area of the rotor first side 120, in the orientation of FIG. 4, is available for frictional engagement, through viscous fluid, with the housing circular friction track 70 than there is when the rotor 53 is in the orientation of FIG. 3. For a fixed fluid volume, the amount of energy it takes to rotate the rotor 53, at a fixed speed, from the orientation of FIG. 3 to the orientation of FIG. 4 will generally, gradually, increase during rotation, since the amount of surface area of the first side 120 of the rotor 53 which is aligned with the circular friction track 70 will also generally, gradually, increase. Conversely, as one rotates from FIG. 4 to FIG. 3, decreasing energy, for a constant speed of rotation, is required. It is seen by comparison of FIG. 3 and FIG. 4 that for a 360° rotation of the rotor 53, two positions of maximal overlap and two positions of minimal overlap are encountered. Referring to FIG. 2, the positions of minimal overlap occur whenever the pedal arms 42 and 45 extend generally vertically, and, referring to FIGS. 4 and 6, the positions of maximal overlap occur whenever the pedal arms 42 and 45 are oriented generally horizontally.

Referring to FIG. 7, the rotor second side 121 is substantially adjacent the cover 52, with a space 135 therebetween. The cover 52 includes an inner surface 136 which is viewed in FIG. 5. Similarly to the housing inner surface 68, the cover inner surface 136 includes a circular friction track 137 having an upper chordal edge 138, a lower chordal edge 139 with a gap 140, and curved side portions 141 and 142. The cover circular track 137 includes an outer edge 145 and an inner edge 146, the inner edge 146 defines a fluid relief drain 147 between the cover curved friction track 137 and a central raised portion 148 which protects the axle 30.

Generally, the cover 52 includes a first upper chordal relief segment 150 and lower second chordal relief segment 151. When the cover 52 is mounted upon the housing 51, FIG. 7, the cover upper chordal relief segment 150 is generally aligned with the housing upper chordal relief segment 78. Also, the cover lower chordal relief segment 151 is generally aligned with the housing lower chordal relief segment 79, FIG. 8. It is readily seen that viscous fluid between the rotor second side 121 and the cover inner surface 136 will have a similar effect on ease of rotation of the pedal axle 30 as does fluid positioned between the rotor first side 120 and the housing inner surface 68.

Figure 5:
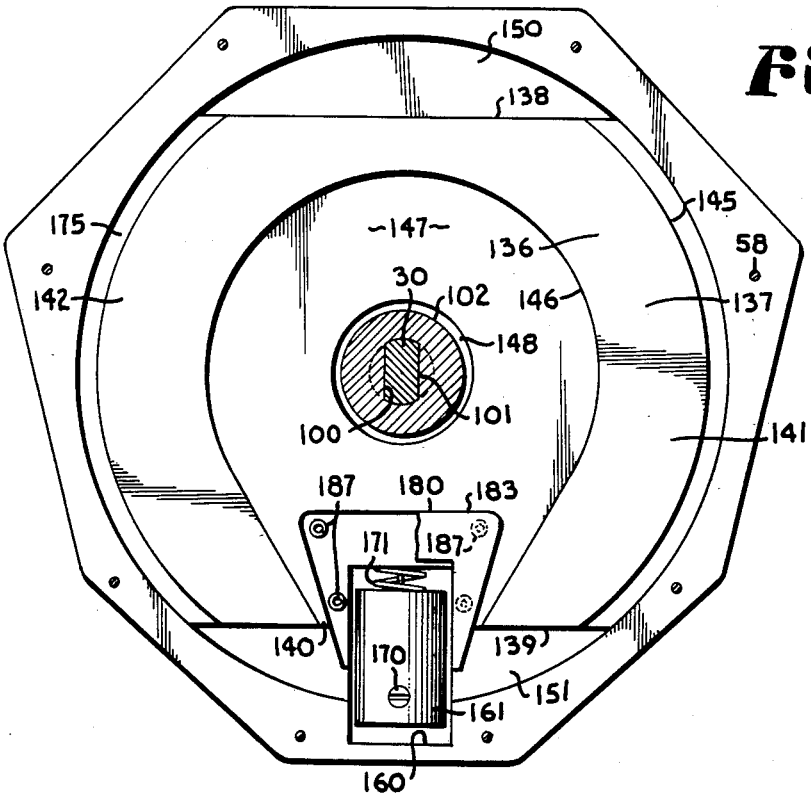
FIG. 5 is an enlarged, fragmentary, side cross-sectional view taken generally along line 5—5 of FIG. 2 and having portions broken away to show detail.

Referring to FIGS. 5, 7 and 8, the cover 52 includes a fluid reservoir 160 thereon. The fluid reservoir 160 communicates with the fluid receiving space 59 between the housing 51, cover 52 and rotor 53 at the lower chordal relief segment 151 of the cover 52. A fluid level adjustment mechanism including a plunger 161 permits the level of fluid 162 in the reservoir 160 to be selectively adjusted. As the plunger 161 is lowered, the fluid level 163 rises. Referring to FIG. 8, at higher fluid levels 163, greater surface area of the rotor 53 is contacted by the fluid 162, as the rotor is rotated through a lower portion 165 of the pedal mechanism 8, where the cover lower chordal segment 151 overlaps the housing lower chordal section 79. Generally, adjustable depth of fluid may be maintained in this area which successive portions of an outer periphery of the rotor 53 engage as the rotor 53 is rotated.

The plunger 161 is controlled by means of cable 168, FIG. 8. The cable 168 includes a first end 169 anchored within the plunger 161 by means of screw 170. Spring 171 tends to bias the plunger 161 downwardly, whereas upward tension upon the cable 168 tends to bias the plunger 161 upwardly. The cable 168 may be controlled by a lever 172 mounted upon the handle bars 7, FIG. 1. Generally, as the plunger 161 is raised, the fluid level 163 decreases, less surface area of the rotor 53 is coated with a fluid 162, less fluid is carried up into the spaces between the rotor 53 and the housing friction track 70, and the rotor 53 and a cover friction track 137, and pedaling is made easier. Conversely, as the plunger 161 is lowered, pedaling becomes more difficult since more fluid is forced between the rotor 53 and the cover 52 and the housing 51.

In the preferred embodiment, a preferred fluid is a silicon fluid having a viscosity of approximately 9,000 centistokes. With such a fluid it has been found that a desirable gap between the rotor 53 and the housing friction track 70 is approximately 0.025 inches. A similar distance spaces the rotor 53 from the cover friction track 137. In the portions of the assembly where relief is desired, as for example at the first chordal segments 78 of the housing 51, the distance between the rotor central portion 103 and the housing inner surface 68 is generally approximately 0.150 inches. The outer rim 104 along the curved edges 114 and 115 of the rotor 53 is raised somewhat and generally spaced approximately 0.060 inches away from the housing inner surface 68 when within a chordal relief segment, and about 0.025 inches when aligned with a circular friction track. Similar dimensions separate the rotor 53 from the cover 52. It will be understood that a groove extends along the outer edge 145 of the cover track 137 and the outer edge 71 of the housing friction track 70. The groove 175 receives the rotor rim 104, as the rotor 53 rotates.

Control of the location of fluid 162 upon the rotor 53 is maintained by a wiper mechanism 180, FIGS. 4 and 5. The wiper mechanism includes a first blade 182 mounted within the housing 51, and a second blade 183 mounted within the cover 52.

Referring to FIG. 4, wiper blade 182 includes two finger extensions thereon. The first extension is 185. The second is broken away in FIG. 4. The wiper first blade 182 is mounted upon the housing inner surface 168 and biased against the rotor 53 by springs 187. Referring to FIG. 8, biasing of the wiper first blade 182 against the rotor 53 is observed. Referring to FIG. 4, if the rotor 53 is rotated clockwise, fluid thereon will engage lead edge 188 on finger 185. The wiper blade 182 tends to force the fluid toward the tip 189 of finger 185, due to the angle of lead edge 188 with respect to motion of the rotor 53. This tends to keep excess fluid 162 off of the rotor 53 and also tends to direct fluid 162 away from central relief drain 90. Should any fluid fall into relief drain 90, it may flow back into the fluid reservoir 160 through gap 88 and generally along the outer edges 190 of the first blade 182. The two finger extensions ensure proper wiping whether rotation of the rotor 53 is clockwise or counter-clockwise.

The second blade 183 is mounted in the cover 152, FIG. 5, in a manner generally similar to the mounting to the first blade 182 in the housing 51. The second blade 183 operates on the side 121 of the rotor 53 which faces the cover 52.

During operation of the exercise cycle 2, air bubbles may tend to form in the viscous liquid 162 and excess liquid 162 may tend to build up along the outer curved edges 114 and 115 of the rotor 53. Referring to FIG. 4, a scraper mechanism 195 is provided to cause turbulence in the fluid 162, in order to release bubbles, and further to remove excess fluid 162 from the outer edges 114 and 115 of the rotor 53. Referring to FIGS. 4 and 8, the scraper mechanism 195 comprises a generally triangular shaped portion 196 of the housing inner surface 68 which projects along an outside periphery 197 of the curved edges 114 and 115 of the rotor 53, whenever the curved edges pass thereby. The raised portion 196 includes a first edge 200 and a second edge 201 which extend at an angle to a tangent of the rotor 53. It has been found that for good scraping results, an angle of approximately 30° is preferred. The raised portion 196 also includes a shoulder 203 which extends along a side portion 205 of the rotor rim 104. Generally, an effective distance between the rotor rim 104 and the scraper mechanism 195 has been found to be approximately 0.025 inches, during scraping. The generally triangular configuration of the scraper 196 permits operation regardless of direction of rotation of the rotor 53.

It has been found that when the chordal relief segment of the rotor 53, housing 51 and cover 52 comprise 80° chordal segments, that the change in energy during a single revolution of the rotor generally closely matches the change in capability of an operator to impart torque in pedaling the device. An 80° chord is conventionally defined in geometry as the angular distance between radaii which extend to opposite ends of the chord. An exemplary diameter for the rotor 53 is approximately ten (10) inches.

It is to be understood that the dimensions given herein are exemplary only and variations may be utilized according to the invention. Also, the position and shape of relief segments in the housing 51, cover 52 and rotor 53 may be substantially varied. For example, relief segments in the rotor may be formed by milling away a portion of a circular rotor, rather than creating a rotor 53 with opposite and parallel side edges 110 and 111. Further, relief designs other than chordal segments may be utilized.

Generally, a variety of materials may be utilized to form the rotor. For example, various easily molded plastics and metals may be utilized, to yield a fairly strong but light rotor. A plastic rotor may be fairly light and desirable. When the rotor is molded, an outer rim, such as rim 104 will generally be preferred in order to lend strength against twisting out of plane.

The cover and housing will generally preferably be made from a suitably strong material having significant heat transfer capabilities. Since it is envisioned that rotation of the rotor, by frictional engagement with fluid, will generate considerable heat, the heat must be dissipated, or the fluid may tend to heat considerably and lose its viscocity. If the cover and housing have sufficiently high heat transfer capabilities, the heat may be radiated through the cover and housing and lost to the atmosphere. It is foreseen that a fluid cooling mechanism may be utilized in cooperation with the present invention. Usually, the cover and housing are appropriately milled or cast pieces of light metal.

As indicated above, operation of the device 1 is by pedaling action of an operator, not shown. As the pedal arms 42 and 45 are rotated, the rotor 53 rotates with respect to the housing 51 and cover 52. Adjustment of the fluid level 163 selectively wets a desired amount of surfaces 120 and 121 of the rotor 53. Generally, the wetting begins along an outer periphery of the rotor 53 and works inwardly as the fluid level increases. The fluid 162 will tend to cause frictional drag when it becomes entrapped between the rotor 53 and the friction tracks 70 and 137, respectively positioned on the housing inner surface 68 and cover inner surface 136. As more fluid 162 is forced between the rotor 53 and the cover 52, and the rotor 53 and the housing 51, greater overall frictional drag is encountered. Control of the amount of fluid 162 may be accommodated by means of lever 172.

During a pedaling cycle, the amount of surface area of the rotor 53 which engages friction tracks 70 and 137, by means of the fluid 162, increases and decreases, with maxima located when the pedal arms 42 and 45 are horizontal and minima located when the pedal arms 42 and 45 extend vertically. Thus, the pedaler finds it easier to pedal during certain portions of rotation and harder at others. As explained above, the ease of pedaling, with respect to frictional drag, generally increases and decreases in the same pattern as the ease of which the pedaler can provide torque to the pedals 10 and 11. As a result, an operator or pedaler encounters a smooth pedaling motion without the need of a cumbersome fly wheel device.

It is to be understood that while certain forms of the present invention have been illustrated and described herein, it is not to be limited to the specific forms or arrangement of parts described and shown.

What is claimed and desired to be secured by Letters Patent is as follows:

1. An exercise cycle for providing exercise to an operator; said cycle comprising:

(a) a housing having an inner surface;

(b) a rotatable pedal axle mounted substantially perpendicularly to said housing inner surface;

(c) pedal means mounted on said pedal axle for rotation of said axle;

(d) a rotor mounted on said pedal axle;

(i) said rotor having a friction surface oriented facing said housing inner surface and being spaced apart therefrom to form a fluid receiving space therebetween;

(ii) said rotation of said rotor causing movement of said rotor friction surface with respect to said housing inner surface;

(iii) said rotor being substantially circular with at least one chordal segment removed therefrom, leaving a chordal extension thereon;

(e) said housing inner surface having a relief portion and a non-relief portion therein:

(i) said rotor chordal extension periodically aligning with, and becoming out of alignment with, said housing relief portion as said rotor is rotated by said pedal means; and (f) fluid level adjustment means for selectively adjusting an amount of fluid positioned in said fluid receiving space;

(g) whereby fluid is selectively positionable in said fluid receiving space; said fluid, when sufficiently viscous, causing frictional drag and resistance to rotation of said rotor with respect to said housing; and (h) whereby when said operator pedals said cycle, said rotor is rotated with energy required to overcome said resistance; and (i) whereby an amount of energy required to pedal said cycle may be selectively increased or decreased by adjustment of said amount of fluid in said receiving space; and (j) whereby a relative amount of energy required to cause rotation of said rotor varies as said rotor is rotated and said chordal extension of said rotor periodically moves through alignment with said housing relief portion and said housing nonrelief portion.

2. An exercise cycle according to claim 1 wherein:

(a) said rotor is substantially circular with two equal and oppositely positioned chordal segments removed therefrom, leaving two equal and oppositely extending chordal extensions and a central circular friction track;

(b) said housing inner surface has a generally circular track positioned for overlap with said rotor chordal extensions and entrapment of fluid therebetween;

(i) said circular track having two oppositely positioned friction portions therein, and two oppositely positioned friction relief portions therein.

3. An exercise cycle according to claim 2, wherein:

(a) said rotor chordal segments are each approximately eighty degree chordal segments; and (b) said circular track friction relief portions are substantially equivalent, in angular size, to said rotor chordal segments.

4. An exercise cycle according to claim 2 wherein:

(a) said pedal means includes a first pedal arm with a first pedal mounted thereon;

(b) said pedal means includes a second pedal arm with a second pedal mounted thereon;

(i) said second pedal arm being mounted in opposite orientation to said first pedal arm, so that whenever said first pedal is positioned at a maximum vertical height, said second pedal is positioned at a minimum vertical height, and so that said pedal arms rotate approximately one hundred and eighty degrees out-of-phase with one another;

(c) said first and second pedal arms being mounted on said pedal axle to extend, with respect to said rotor, in a direction generally parallel to edges of said rotor where chordal segments have been removed, and generally bisecting said chordal extensions;

(d) said housing circular track relief portions being positioned for maximal overlap with said rotor chordal extensions, wherever either one of said pedals is positioned at a position of maximum vertical height, or minimum vertical height; and (e) said housing circular track non-relieved portions being oriented for maximal frictional alignment with said rotor chordal extensions, whenever said pedals are positioned at a vertical position halfway between said maximum and said minimum positions of vertical height;

(f) whereby an operator pedaling said rotor, to rotate same, experiences a minimum resistance whenever said pedals are at vertical extremes, and a maximum reistance whenever said pedals are positioned at a mid-point between said vertical extremes.

5. An exercise cycle according to claim 2 including:

(a) a wiper mechanism generally urging fluid on said rotor friction surface substantially toward an outer periphery of said rotor;

(b) whereby a relatively even distribution of fluid on said rotor friction surface is maintained.

6. An exercise cycle according to claim 5 wherein:

(a) said wiper mechanism includes a wiper blade nonrotatably mounted adjacent said rotor friction surface.

7. An exercise cycle according to claim 2 including:

(a) a scraper mechanism for partially removing fluid from an outer periphery of said rotor;

(b) whereby turbulance is created in said fluid for releasing trapped air bubbles therefrom.

8. An exercise cycle according to claim 2 wherein:

(a) said rotor has a second friction surface;

(b) a cover is mounted adjacent said housing and trapping said rotor therebetween;

(i) said cover having an inner surface with a friction track and relief portions thereon;

(ii) said cover inner surface friction track being generally circular and aligned with said housing inner surface; said cover inner surface relief portions being generally aligned with said housing inner surface relief portions; and (c) said rotor second friction surface being oriented facing said cover inner surface and being spaced apart therefrom to form a fluid receiving space therebetween;

(i) said rotation of said rotor causing movement of said rotor second friction surface with respect to said cover inner surface.

9. An exercise device, for providing physical exercise to an operator, in combination with a sufficiently viscous fluid for operation of said device; said combination including:

(a) a housing having an inner surface;

(b) a rotor rotatably mounted on said device;

(i) said rotor having actuation means associated therewith for engagement by said operator to generate rotation of said rotor;

(ii) said rotor having a friction surface; said rotor friction surface facing said housing inner surface and being spaced apart therefrom to form a fluid receiving space therebetween;

(iii) said rotation of said rotor causing movement of said rotor friction surface with respect to said housing inner surface;

(c) fluid for being positioned in said fluid receiving space;

(d) fluid level adjustment means for selectively adjusting an amount of fluid positioned in said fluid receiving space; and (e) friction relief means providing a variable amount of frictional resistance to rotation of said rotor, during a single revolution of said rotor, while said fluid level adjustment means is maintained substantially unadjusted;

(i) said fluid relief means being periodic in operation so as to repeat with successive revolutions of said rotor;

(f) whereby said fluid is selectively positionable in said fluid receiving space to cause resistance to rotation of said rotor with respect to said housing; and (g) whereby a relative amount of energy required to cause rotation of said rotor, at a selected fluid amount and fixed rotation rate, varies as said rotor is rotated, and repeats in a periodic cycle; and, (h) whereby when said operator rotates said rotor, energy is required to overcome said resistance and said operator receives exercise by providing said energy.

10. A combination according to claim 9 wherein:

(a) said fluid has a viscosity of between 3,000 centistokes and 22,000 centistokes.

11. A combination according to claim 10 wherein:

(a) said fluid has a viscosity of about 9,000 centistokes.

12. An exercise device for providing physical exercise to an operator, said device comprising:

(a) a housing having an inner surface;

(b) a rotor rotatably mounted on said device;

(i) said rotor having actuation means associated therewith for engagement by said operator to generate rotation of said rotor;

(ii) said rotor having a friction surface; said rotor friction surface facing said housing inner surface and being spaced apart therefrom to form a fluid receiving space therebetween;

(iii) said rotation of said rotor causing movement of said rotor friction surface with respect to said housing inner surface;

(c) fluid level adjustment means for selectively adjusting an amount of fluid positioned in said fluid receiving space; and, (d) friction relief means providing a variable amount of frictional resistance to rotation of said rotor, during a single revolution of said rotor, while said fluid level adjustment means is maintained substantially unadjusted;

(i) said fluid relief means being periodic in operation so as to repeat with successive revolutions of said rotor;

(e) whereby fluid is positionable in said fluid receiving space; said fluid, when sufficiently viscous, causing frictional drag and resistance to rotation of said rotor with respect to said housing;

(f) whereby, when said operator rotates said rotor; energy is required to overcome said resistance and said operator receives exercise by providing said energy;

(g) whereby an amount of energy required to rotate said rotor may be selectively increased or decreased by adjustment of said fluid in said receiving space; and, (h) whereby a relative amount of energy required to cause rotation of said rotor, at a selected fluid amount and fixed rate of rotation, varies as said rotor is rotated, and said amount of energy repeats, in a periodic cycle, as said rotor is rotated through successive revolutions.

13. An exercise device according to claim 12 wherein:

(a) said friction relief means includes a housing surface friction relief portion and a rotor friction relief portion;

(i) said housing surface friction relief portion being substantially stationary;

(ii) said rotor friction relief portion being rotatable, as said rotor rotates, through orientations of maximal and minimal alignment with said housing surface relief portion;

(b) whereby, as said rotor is rotated by said operator, periodic alignment of said housing friction relief portion with said rotor friction relief portion achieves an orientation of minimal frictional resistance to said rotation.

14. An exercise device for providing physical exercise to an operator, said device comprising:

(a) a housing having an inner surface;

(b) a rotor rotatably mounted on said device;

(i) said rotor having actuation means associated therewith for engagement by said operator to generate rotation of said rotor;

(ii) said rotor having a first friction surface and a second friction surface; said first friction surface facing said housing inner surface and being spaced apart therefrom to form a first fluid receiving space therebetween;

(iii) said rotation of said rotor causing movement of said rotor first friction surface with respect to said housing inner surface;

(c) a cover having an inner surface;

(i) said rotor second friction surface facing said cover inner surface and being spaced apart therefrom to form a second fluid receiving space therebetween;

(ii) said rotation of said rotor causing movement of said rotor second friction surface with respect to said cover inner surface;

(d) fluid level adjustment means for selectively adjusting an amount of fluid positioned in said first and second fluid receiving spaces; and, (e) friction relief means providing a variable amount of frictional resistance to rotation of said rotor, during a single revolution of said rotor, while said fluid level adjustment means is maintained substantially unadjusted;

(i) said fluid relief means being periodic in operation so as to repeat with successive revolutions of said rotor;

(f) whereby fluid is positionable in said fluid receiving spaces; said fluid, when sufficiently viscous, causing frictional drag and resistance to rotation of said rotor with respect to said cover and housing;

(g) whereby when said operator rotates said rotor, energy is required to overcome said resistance and said operator receives exercise by providing said energy;

(h) whereby an amount of energy required to rotate said rotor may be selectively increased or decreased by adjustment of said amount of fluid in said receiving spaces; and, (i) whereby a relative amount of energy required to cause rotation of said rotor, at a selected fluid amount, varies as said rotor is rotated; and said amount of energy repeats, in a periodic cycle, as said rotor is rotated through successive revolutions.

15. An exercise device for providing physical exercise to an operator, said device comprising:

(a) a stationary friction surface;

(b) a rotor rotatably mounted in said device;

(i) said rotor having actuation means associated therewith for engagement by said operator to generate rotation of said rotor;

(ii) said rotor having a rotor friction surface; said rotor friction surface generally facing said stationary friction surface and being spaced apart therefrom to form a fluid receiving space therebetween;

(iii) said rotation of said rotor causing shearing movement of said rotor friction surface relative to said stationary friction surface.

(c) fluid positioning means selectively positioning fluid in said fluid receiving space; said fluid, when sufficiently viscous, causing frictional drag and resistance to said shearing movement; and, (d) friction relief means providing a variable amount of frictional resistance to rotation of said rotor, during a single revolution of said rotor;

(i) said fluid relief means being periodic in operation so as to repeat which successive revolutions of said rotor;

(e) whereby when said operator rotates said rotor, energy is required to overcome said resistance and said operator receives exercise by providing said energy; and, (f) whereby a relative amount of energy required to cause rotation of said rotor varies as said rotor is rotated, at a selected amount of fluid in said fluid receiving space; and, said amount of energy repeats, in a periodic cycle, as said rotor is rotated through successive revolutions.

16. An exercise device according to claim 15 wherein:

(a) said friction relief means includes a stationary friction surface friction relief portion and a rotor friction relief portion;

(i) said rotor friction relief portion being rotatable, as said rotor rotates, through orientations of maximal and minimal shearing alignment with said stationary friction surface friction relief portion;

(b) whereby, as said rotor is rotated by said operator, periodic alignment of said stationary friction surface friction relief portion with said rotor friction relief portion achieves an orientation of minimal frictional resistance to rotation.

17. An exercise device for providing physical exercise to an operator, said device comprising:

(a) a stationary friction surface;

(b) a movable friction surface mounted in said device;

(i) said movable friction surface having actuation means associatdd therewith for engagement by said operator to generate movement of said movable friction surface relative to said stationary friction surface;

(ii) said movable friction surface generally facing said stationary friction surface and being spaced apart therefrom to form a fluid receiving space therebetween;

(iii) said movement of said movable friction surface causing shearing movement of said movable friction surface relative to said stationary friction surface;

(c) fluid positioning means selectively positioning fluid in said fluid receiving space; said fluid, when sufficiently viscous, causing frictional drag and resistance to said shearing movement; and, (d) friction relief means providing a variable amount of frictional resistance to movement of said movable friction surface relative to said stationary friction surface, said friction relief means inlcluding periodicity means to generate a variation in said variable amount of frictional resistance according to a repeatable pattern;

(e) whereby when said operator moves said movable friction surface, energy is required to overcome said resistance and said operator receives exercise by providing said energy; and, (f) whereby a relative amount of energy required to cause movement of said movable friction surface varies, as said shearing movement occurs, at a selected amount of fluid in said fluid receiving space.

18. An exercise, device for providing physical exercise to an operator, said device comprising:

(a) a housing having an inner surface;

(b) a rotor rotatably mounted on said device;

(i) said rotor having a substantially oval-shaped outer periphery portion with first and second, generally equal and opposite, chordal relieved segments leaving first and second, generally equal and opposite, chordal extensions in said rotor;

(ii) said rotor having actuation means associated therewith for engagement by said operator to generate rotation of said rotor;

(iii) said rotor having a friction surface; said rotor friction surface facing said housing inner surface and being spaced apart therefrom to form a fluid receiving space therebetween;

(iv) said rotation of said rotor causing movement of said rotor friction surface with respect to said housing inner surface;

(c) a fluid reservoir oriented for at least a portion of said rotor chordal extensions to dip into same, as said rotor is rotated;

(d) viscous fluid received within said fluid reservoir in sufficient amount to be engaged by said chordal extensions as said rotor rotates; and, (e) said viscous fluid being positionable in said fluid receiving space;

(i) said fluid being transferred to said fluid receiving space, from said fluid reservoir, by said rotor chordal extensions as said rotor rotates;

(ii) said fluid, when in said fluid receiving space and when sufficiently viscous, causing frictional drag and resistance to rotation of said rotor with respect to said housing:

(f) whereby, when said operator rotates said rotor, energy is required to overcome said resistance and said operator receives exercise by providing said energy.

19. An exercise device according to claim 18 including:

(a) fluid level adjustment means for selectively adjusting a depth of fluid in said fluid reservoir;

(i) said fluid level adjustment means including a plunger mechanism for selectively adjusting a level of a fixed volume of fluid in said fluid reservoir;

(b) whereby an amount of said rotor chordal extensions which engage fluid in said fluid reservoir, as said rotor rotates, may be selectively increased or decreased by adjustment of said depth of a fixed volume of said fluid; and, (c) whereby an amount of energy required to rotate said rotor may be selectively increased or decreased by adjustment of said amount of fluid in said receiving space.

20. An exercise device according to claim 19 wherein:

(a) said fluid has a viscosity of between about 3,000 centistokes and about 22,000 centistokes.

21. An exercise device according to claim 20 including:

(a) a wiper mechanism generally urging fluid on said rotor friction surface substantially toward said outer periphery portion of said rotor, as said rotor rotates.

22. An exercise device according to claim 21 wherein:

(a) said wiper mechanism includes a wiper blade nonrotatably mounted adjacent said rotor friction surface.

23. An exercise device according to claim 22 including:

(a) a scraper mechanism for at least partially removing fluid from said outer periphery portion of said rotor and directing said fluid into said fluid reservoir, as said rotor rotates.

24. An exercise device for providing physical exercise to an operator, said device comprising:

(a) a housing having an inner surface;

(b) a rotor rotatably mounted on said device;

(i) said rotor having actuation means associated therewith for engagement by said operator to generate rotation of said rotor;

(ii) said rotor having a friction surface; said rotor friction surface facing said housing inner surface and being spaced apart therefrom to form a fluid receiving space therebetween;

(iii) said rotation of said rotor causing shearing movement of said rotor friction surface with respect to said housing inner surface;

(c) a fluid reservoir oriented for at least a portion of said rotor to dip into same, as said rotor is rotated;

(d) fluid level adjustment means for selectively adjusting a depth of a fluid in said fluid reservoir;

(i) said fluid level adjustment means including a plunger mechanism for selectively adjusting a level of a fixed volume of fluid in said reservoir;

(e) a wiper mechanism oriented to urge fluid on said rotor friction surface substantially toward an outer periphery of said rotor, as said rotor rotates;

(f) a scraper mechanism for at least partially removing fluid from said outer periphery of said rotor and directing said fluid into said fluid reservoir, as said rotor rotates;

(g) whereby fluid is selectively positionable in said fluid receiving space; said fluid, when sufficiently viscous, causing frictional drag and resistance to rotation of said rotor with respect to said housing;

(h) whereby when said operator rotates said rotor, energy is required to overcome said resistance and said operator receives exercise by providing said energy;

(i) whereby a surface area of rotor which engages fluid in said fluid reservoir, as said rotor rotates, may be selectively increased or decreased by adjustment of said fluid level adjustment means; and, (j) whereby an amount of energy required to rotate said rotor, may be selectively increased or decreased by adjustment of said amount of fluid in said receiving space.

25. An exercise device according to claim 24 including:

(a) a viscous fluid in said fluid reservoir, said viscous fluid having a viscosity of between about 3,000 centistokes and about 22,000 centistokes.

* * * * *